United States Patent [19]

Schaumann

[11] 4,117,562

[45] Oct. 3, 1978

[54] WATER WALKER

[76] Inventor: Peter H. Schaumann, 15 Jasmine La., Port St. Lucie, Fla. 33452

[21] Appl. No.: 792,571

[22] Filed: May 2, 1977

Related U.S. Application Data

[60] Continuation-in-part of Ser. No. 656,578, Feb. 9, 1976, abandoned, which is a division of Ser. No. 400,193, Sep. 21, 1973, Pat. No. 3,936,897.

[51] Int. Cl.[2] ..... A63C 15/00

[52] U.S. Cl. ..... 9/310 D; 114/251; 114/253

[58] Field of Search ..... 9/310 D, 310 B, 310 C, 9/310 R, 6 P, 2 S; 114/253, 242, 288, 289, 230, 251; 280/11.37 E, 11.37 J

[56] References Cited

U.S. PATENT DOCUMENTS

| | | | |
|---|---|---|---|
| 2,153,939 | 4/1939 | Schaupp | 9/310 D |
| 2,248,307 | 7/1941 | Richards et al. | 9/310 D |
| 2,694,209 | 11/1954 | Lippincott | 9/310 D |
| 3,031,696 | 5/1962 | Brabb | 9/310 D |
| 3,298,343 | 1/1967 | Juhnke | 114/56 |
| 3,382,833 | 5/1968 | Wukowitz | 114/289 |
| 3,585,664 | 6/1971 | Thompson | 9/310 C |
| 3,716,881 | 2/1973 | Tilings | 9/310 D |
| 3,835,494 | 9/1974 | Dougherty | 9/310 D |

*Primary Examiner*—Trygve M. Blix
*Assistant Examiner*—Sherman D. Basinger
*Attorney, Agent, or Firm*—Watson, Cole, Grindle & Watson

[57] ABSTRACT

A water walker for enabling an individual to walk upon water including a pair of elongated buoyant water walker assemblies which can be attached to the feet of the user. Each assembly includes a buoyant flotation member which has a runner longitudinally extending along a substantial portion of the bottom of the buoyant member. The runner has a hollow section which is open at both longitudinal ends and is closed at the bottom by a cover member, thereby forming an effective jet water chamber through the hollow chamber. A control mechanism is arranged within this hollow section of the runner and is movable between a first position allowing water to pass through the hollow section when the assembly is moved in a forward direction and a second position blocking the passage of water through the hollow chamber and hence preventing slippage of the assembly in a rearward direction.

9 Claims, 11 Drawing Figures

WATER WALKER

RELATED APPLICATION

The present application is a continuation-in-part of U.S. patent application Ser. No. 656,578, filed Feb. 9, 1976, now abandoned, which is a division of Ser. No. 400,193, filed Sept. 21, 1973, now U.S. Pat. No. 3,936,897.

BACKGROUND OF THE INVENTION

The present invention relates to a buoyant water walker including a pair of water walker assemblies adapted to be attached to the feet of a prospective user in order to support the weight of the user in the water and enable him to propel himself along the water while in a standing position.

While numerous devices have previously been developed for enabling individuals to walk upon water, many of these devices have suffered from a lack of stability and/or mobility. In the previously developed devices, even where sufficient lateral stability was provided, a significant problem of rear slippage often occurred. Such a problem of rear slippage occurs when the individual user attempts to move one foot in a forward direction, the other foot and the attached assembly have a tendency to slip in a rearward direction. Such slippage, in addition to seriously retarding the forward movement, creates an inherent instability.

Two previously developed water walkers are illustrated in U.S. Pat. Nos. 3,112,504 issued to C. F. Carlton and 3,479,674 issued to R. L. Beymer. In the patent to Carlton, a water walker is illustrated which has a plurality of vanes, each of which is movable between an extended pendant propelling position and an elevated glide position. In the patent to Beymer, a water walker is provided in which water is taken into a hollow chamber due to a suction force created when the foot of the user is lifted and the water is subsequently expelled through the rear of the chamber thereby creating a force for urging the assembly in a forward direction.

SUMMARY OF THE INVENTION

The object of the present invention is to provide an improved water walker apparatus for enabling an individual to more easily walk on water with a greater degree of stability.

Another object of the present invention is to provide a water walker which enables the user to also walk on land or to step over objects floating in the water or surmount obstacles such as sand bars or logs without causing damage to the water walker.

A further object of the present invention is to provide a water walker in which the stride which the user can take is controlled so as to help maintain the stability of the user of the water walker by guarding against lateral spreading of the water walking assemblies and overstriding when walking.

A still further objective of the present invention is to provide a water walker that can be easily steered so that the course of travel of the walker can be altered at the will of the user.

An even further objective of the present invention is to provide a water walker that will automatically attain the proper angle on its forward stride through the water, to reduce walking effort.

A further objective of the present invention is to provide a simple and positive method of securing the walkers together at an even height to transform them into a comfortable floatation platform for resting or fishing.

A still further objective of the present invention is to make it possible for the user of the water walker to discharge, while underway, excess water which may have accumulated in the foot cavity.

An even further objective of the present invention is to provide a quickly attachable hook-up for easy towing of a floating duffle box or fish cooler.

These objectives are achieved in accordance with the water walker apparatus of the present invention. This water walker includes a pair of elongated buoyant water walker assemblies which can be attached to the feet of the prospective user. Each assembly includes a buoyant flotation member which has a runner longitudinally extending along a substantial portion of its bottom. The runner has a hollow section extending along its entire longitudinal length, with the hollow section being open at both longitudinal ends. The bottom of the hollow section of the runner is covered by a cover member. A control mechanism is arranged within the hollow section of the runner, which mechanism is movable between a first position for allowing movement of the assembly in a forward direction and a second position for preventing slippage of the assembly in a rearward direction.

The control mechanism includes a pair of plates mounted along a vertical axis within the bow of the hollow section of the runner. These plates are pivotable between an open position when the water walker assembly is moved in a forward direction and a closed position for blocking the passage of water through the hollow section and thereby retarding movement of the water walker assembly in a rearward direction. The hollow section with the control mechanism in effect operates as a jet stream system allowing passage of water through the section from bow to stern while blocking passage of water in the opposite direction and thereby easily enabling the user to move in a forward direction while substantially retarding rearward movement of the assembly and any resulting slippage which would otherwise occur.

The cover member which covers the bottom of the hollow section of the runner is made of a wear-resistant plate for enabling the user to walk on rigid surfaces, such as on land or over objects floating in the water or other objects without causing damage to the water walker. The cover plate includes three parallel fins extending down from the bottom and extending longitudinally thereof. The bow portion of the cover plate is inclined to aid forward movement of the water walker in the water.

The lateral walls of the runner extending along its entire longitudinal length are slanted adjacent the bow and are substantially vertical adjacent the stern. These shapes in conjunction with the bow having a greater buoyancy relative to the stern permits easier turning and guiding of the water walkers. The differential buoyancy also causes the bow to rise when the user shifts his weight off one of the water walkers thereby enabling the user to move the walker in a forward direction with greater ease.

A foot cavity is removably attached to the water walker approximately in the center of the walker. A resilient pouch is releaseably attached to an exterior lip of the cavity and can be readily removed to bail water from the foot cavity while the water walker is being used.

DESCRIPTION OF THE PREFERRED EMBODIMENTS

Figure 1:
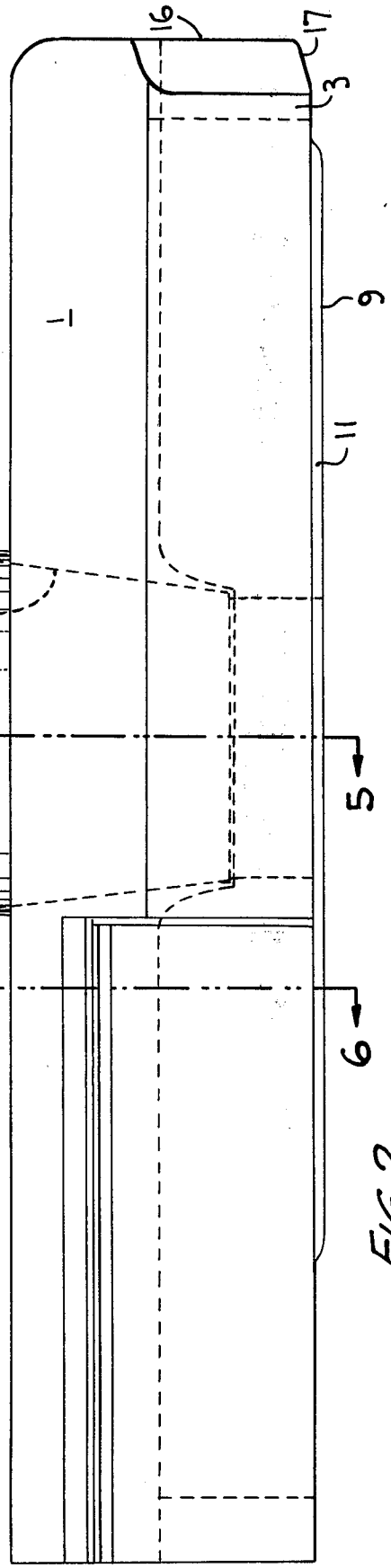
FIG. 1 is a side elevational view of a water walker assembly in accordance with the present invention.
Figure 2:
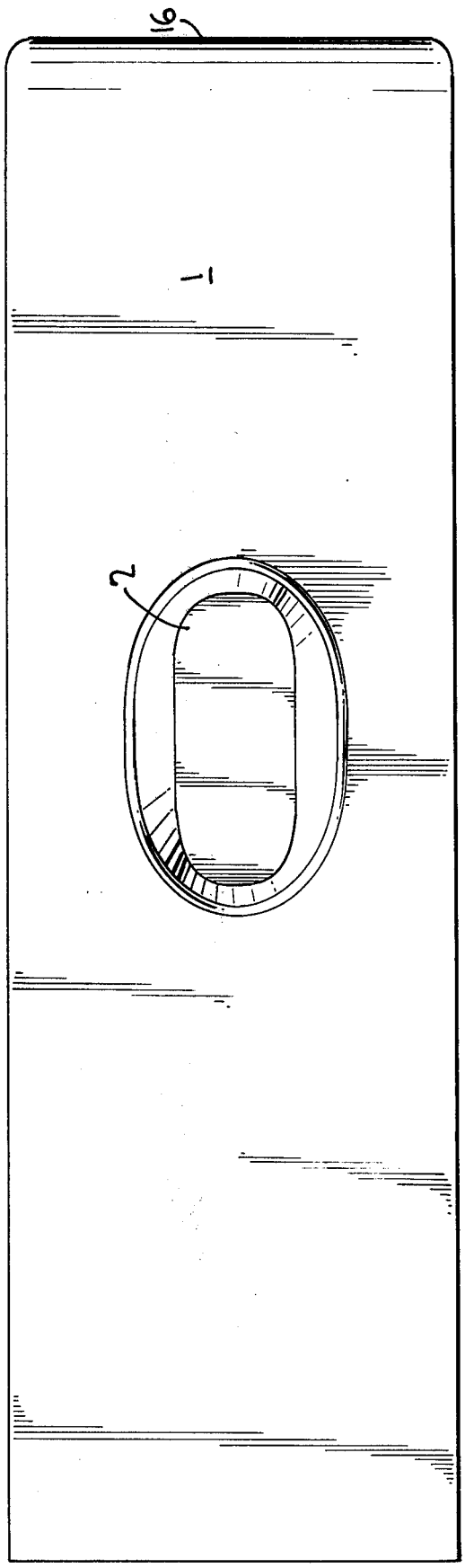
FIG. 2 is a top plan view of the water walker assembly illustrated in FIG. 1.

The water walker of the present invention includes a pair of water walker assemblies, such as the assembly illustrated in FIG. 1. Each assembly is formed from a buoyant member 1 having a runner 3 extending in a longitudinal direction along its bottom. Buoyant member 1 has a cavity 2 therein which is provided with straps or other means to secure or attach the water walker to the foot of the user.

Figure 3:
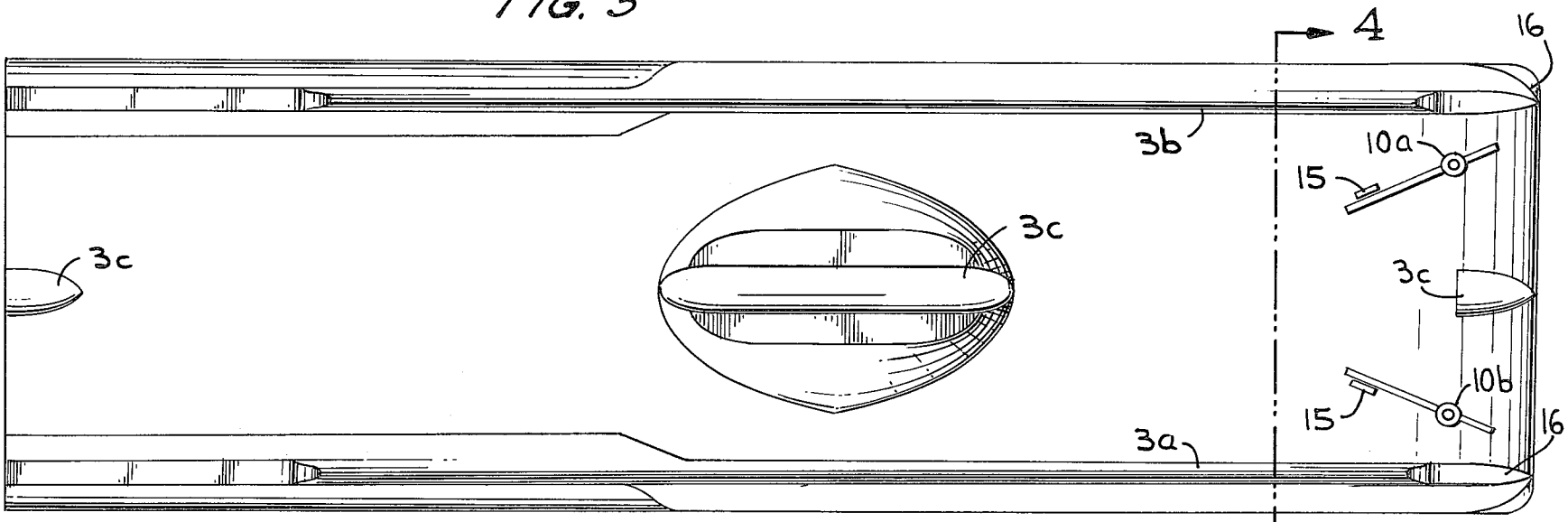
FIG. 3 is a bottom plan view of the water walker assembly illustrated in FIG. 1 with the cover plate being removed for the sake of clarity and the control plates pivoted into their own position.
Figure 6:
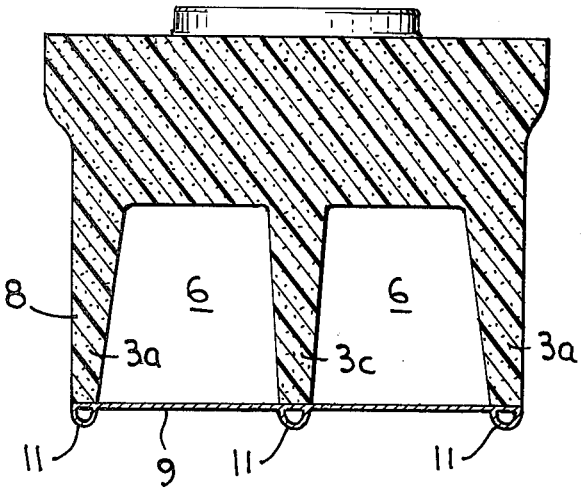
FIG. 6 is a cross-sectional view of a portion of the water walker assembly taken along lines 6—6 in FIG. 1.

Runner 3 includes two exterior lateral walls 3*a* and 3*b* extending longitudinally along the length of buoyant member 1 and a segmented centered wall 3*c* at the bow, center, and stern of the buoyant member 1, as illustrated in FIG. 3. Cover plate 9 is attached to the bottom of runners 3*a, b,* and *c* so as to form a hollow section 6 therewith which is only open at the respective longitudinal ends. The outside lateral sidewalls of runner 3 adjacent the bow are sloped as indicated at 7 in FIG. 4 so that outer walls 3 are wider at their top adjacent to buoyant member 1 than at their bottoms adjacent to cover plate 9. The shape of lateral walls of runers 3 change as they extend toward the stern of the buoyant member so that adjacent the stern, the exterior portion of the lateral walls are substantially vertical at 8 as illustrated in FIG. 6. The difference of the configuration in the bow versus the stern portion of runners 3 aid in turning the water walker as will be discussed below. The bow portion of runners 3 terminates in a substantially vertical line 16 to aid movement through the water. Similarly, lower edge 17 of runners 3 are inclined as illustrated in FIG. 1 to aid in the forward movement of the water walker through the water.

Figure 4:
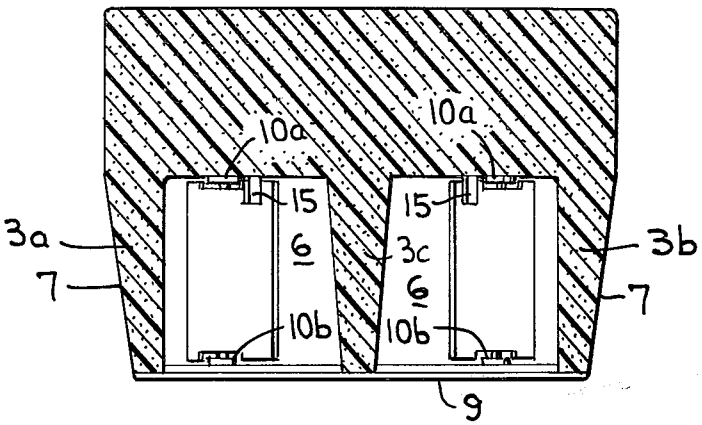
FIG. 4 is a cross-sectional view of the water walker assembly taken along lines 4—4 in FIG. 1 with the control plates pivoted into their open position.
Figure 7:
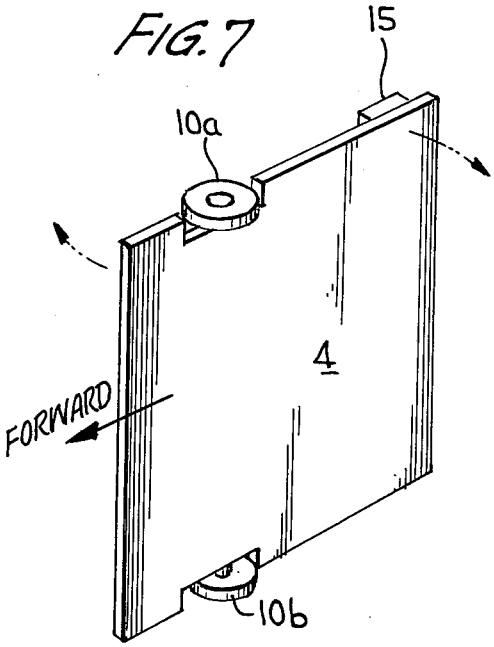
FIG. 7 is a perspective view of a control plate along with its bushings and stop for insertion within the hollow sections of each water walker assembly.

A control mechanism for enabling the water walker assemblies to easily move in a forward direction while retarding their movement in a rearward direction so as to prevent slippage is provided within each of the hollow sections. This control capability is provided by the inclusion of plates 4 which are pivotably mounted about a vertical axis within bushings 10*a* in the runner and 10*b* in the cover plate. Plate 4 is movable between an open position and a closed position. In its open position, the plates allow water to pass through the respective hollow section so as to effectively create a jet stream of water through the hollow section, such as shown in FIG. 3 and 4. In its closed position, the plates block the movement of water through the hollow section. Thus, plate 4 is rotatable in bushings 10*a* and 10*b* in the direction of the arrows illustrated in FIG. 7. The ends of plate 4 rest against center runner 3*c* adjacent the bow in the closed position. A stop 15 is mounted to the top of the hollow section behind bushing 10*a* and is laterally offset towards the center. The position of stop 15 causes plate 4 to be included at an acute angle, for example 10°, with respect to the water flow through hollow section 6 when the plate is in the opened position illustrated in FIG. 3. This inclination enables the plate to more easily open and close during the forward and rearward movement of the water walker.

As the user of the water walker moves one foot and the attached assembly in a forward direction, the water pressure on plate 4 causes the plate to be pivoted into its open position thereby allowing water to pass through the hollow section. When this forward movement of the assembly stops, however, if a rearward slippage begins to occur water within the hollow section will attempt to travel in a direction from the stern of the assembly towards the bow. This latter movement of the water will cause plate 4 to be swung into its closed position thereby blocking the movement of such water and in effect retarding rearward movement, i.e., slippage, of the assembly. Such slippage of the assembly becomes especially significant with respect to the stability of one assembly as the user is moving the other assembly in the forward direction. During the movement of the other assembly, the user inherently uses the first assembly as a push-off point which in effect creates a force in a rearward direction. By effectively closing off the hollow section and preventing the passage of water through the section, however, movement of the assembly in a rearward direction is significantly retarded.

Figure 8:
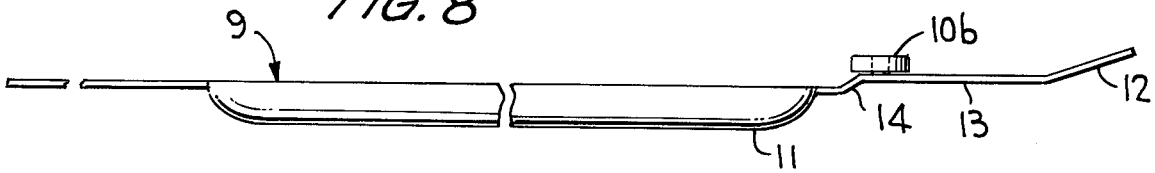
FIG. 8 is a foreshortened, exploded side elevational view of the cover plate.

Cover plate 9 as illustrated in detail in FIG. 8 includes three parallel fins 11 extending longitudinally from a position adjacent the bow, along a substantial portion of the length of cover 9 but terminates short of the stern. Fins 11 are of a depth sufficient to add stability while not interfering with the turning or the horizontal rotation of the water walker. Adjacent the bow termination of fins 11, cover plate 9 is inclined and includes a short forward horizontal section 13 which terminates at an inclined portion 12. The angle of inclined portion 12 meets edge 17 of the leading edge of runners 3 and also aids in the forward movement of the bow in the water. Bushing 10*b* is shown on horizontal portion 13 of cover plate 9.

In walking on the water, effort is required to propel the water walker to the front of the stride. The embodiment of the present invention allows the water walker, as the user's weight is being shifted from it, to rise up in the bow more quickly than in the stern, so that the bow is well above the surface of the water. At this angle, much less effort is required to stride forward. By centering the foot cavity 2 and unbalancing the water walker such that the buoyancy of the bow is greater than that of the stern, the bow will rise when the user shifts his weight.

If the user, during the course of his walking, desires to change direction, he may do so by shifting his weight away from one of the water walkers, allowing the unloaded water walker to rise to its idling position with the bow raised. In this position a side push of the foot will rotate the bow of the walker in the direction pushed. This is made possible by the tendency of the rear section, acting as a fulcrum, not to rotate. The user then rotates the other water walker in the same manner, and the two are then facing in their new direction.

Figure 9:
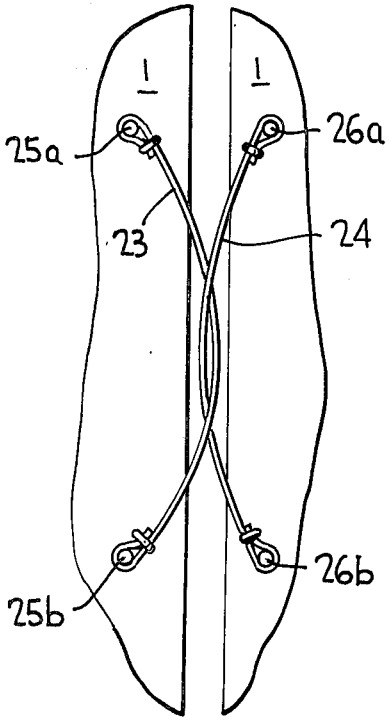
FIG. 9 is a top plan view of a portion of two water walker assemblies interconnected by a pair of cables for controlling the relative movement of the assemblies.

If the user of the water walker during utilization attempts to take too long of a step, i.e., too long of a stride between the water walker assemblies, the assemblies could begin to move in opposite directions away from each other thereby leading to a greater degree of instability. Also, there is a hazard in spreading of the walkers. For this reason, in order to control the stride between the two assemblies, a set of cables 23 and 24 are each attached to one of the assemblies, as shown in FIG. 9. Cable 23 is attached to one assembly at connecting joints 26*a* and 26*b*. Before the cables are attached to their respective assemblies, however, the cables are interlooped. Consequently, the cables serve to control the length of the stride which the user can take when utilizing the water walker and prevent spreading of the walkers.

Figure 10:
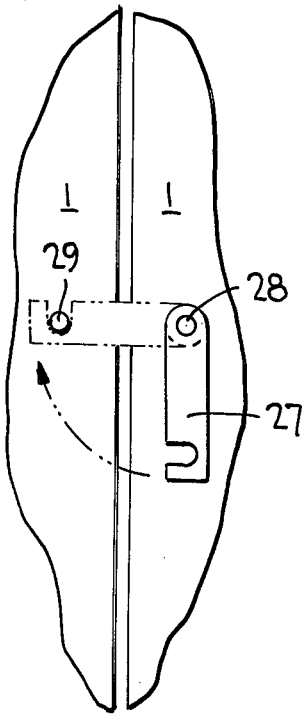
FIG. 10 is a top plan view of a portion of a pair of water walker assemblies with the provision of a latch for hooking the assemblies together.

When the user of the water walker wants to stand in a single position within the water without any movement, it becomes desirable for relative movement between the two assemblies to be eliminated. For this purpose, a coupling mechanism as shown in FIG. 10 can be provided. This coupling mechanism includes a latch 27 which is pivotably mounted around pin 28 so as to be pivotable into a position in which it can engage another pin 29 thereby coupling the two assemblies together into a fixed relationship.

Figure 11:
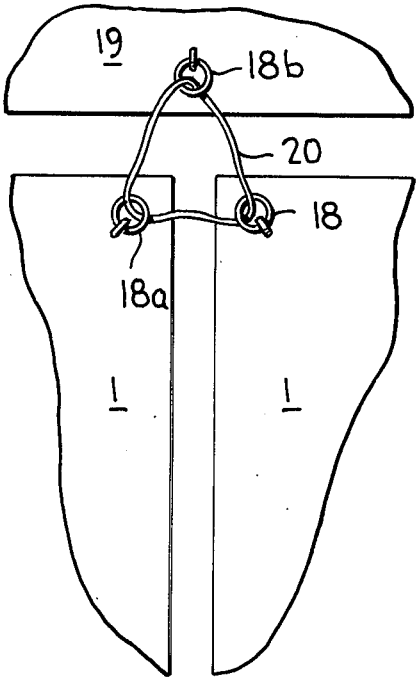
FIG. 11 is a top plan view of a portion of a pair of water walker assemblies and a floating device interconnected by a cable for towing the flotation device.

Many users, traveling to offshore islands or to a boat, moored offshore, will want to transport supplies, duffle bags, guns, fishing tackle, etc. It is possible to do this with a duffle trailer, by using a tow hook-up as illustrated in FIG. 11. This consists of a ring 18*a* attached to the stern of each water walker and a ring 18*b* on the trailer 19. A continuous length of plastic covered bronze cable 20 is threaded through each ring 18 but is not attached thereto. While towing, this hook-up provides a flexible pull, using only one-half a normal tow strain, due to the pulley effect of cable 20 sliding through the rings.

Figure 5:
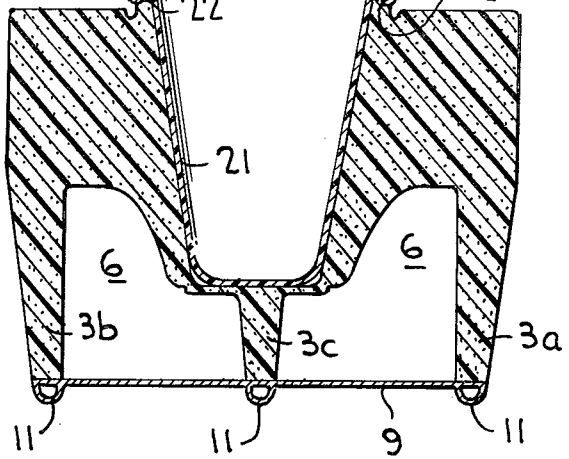
FIG. 5 is a cross-sectional view of the water walker assembly taken along lines 5—5 in FIG. 1.

During heavy seas, or in rain, excess water may accumulate in the foot cavity of the water walker. The user will probably want to discharge or bail this water, while underway. This is possible with the removable foot cavity pouch 21 which may be unsnapped, dumped, and replaced while the walker is on the water. As illustrated in FIG. 5, the foot cavity pouch 21 has a bead 21*a* which fits into a rim 22 in the foot cavity exterior wall. By making the pouch 21 of resilient material, it will hold itself tightly against the exterior of the foot cavity wall.

It is noted that the above description and the accompanying drawings are provided merely to present exemplary embodiments of the present invention and that additional modifications of such embodiments are possible within the scope of this invention without deviating from the spirit thereof.

I claim:

1. Apparatus for enabling an individual to walk on water including a pair of elongated buoyant water walker assemblies adapted for attachment to the feet of such individuals, each of said assemblies comprising:

a buoyant flotation member;

a runner member extending longitudinally along a substantial portion of the bottom of said buoyant member, said runner member having side walls forming a hollow section extending along its entire longitudinal length and being open at both longitudinal ends;

a cover member covering the bottom of said hollow section of said runner member;

control means arranged within said hollow section of said runner and being movable between a first position for allowing movement of said buoyant member in a forward direction and a second position for preventing slippage of said buoyant member in a rearward direction; and said runner member further including a longitudinally extending member spaced between said side walls of said runner member so as to form two longitudinally extending hollow sections within said runner member and said control means including two pivotable plates mounted along a vertical axis within each of said hollow sections and being pivotable between an open position so that as said water walker moves in a forward direction water is allowed to pass through said hollow section and a closed position in which said plates substantially closes said hollow section and blocks passage of water through said hollow section thereby retarding movement of said buoyant member, as well as a stop mounted in said hollow section for each of said pivotable plates for holding said pivotable plates inclined relative to the water flow through said hollow section with said plates in the open position.

2. Water walking apparatus as defined in claim 1 wherein said cover member is a wear-resistant plate for enabling the individual using said water walker to walk on rigid surfaces.

3. Water walking apparatus as defined in claim 1 wherein said runner member has the outer side of said side walls adjacent the bow of said buoyant member sloped so that said outer side walls are wider at their top adjacent to said buoyant member than at their bottom adjacent to said cover member and the shape of said outer side walls changes as said walls extend towards the stern of said buoyant member so that at the stern said outer walls are substantially vertical.

4. Water walking apparatus as defined in claim 1 wherein said cover member is inclined at its bow and wherein the bow of said buoyant flotation member is more buoyant than the stern whereby the bow of said water walking assembly rises when the user shifts weight therefrom.

5. Water walking apparatus as defined in claim 1 wherein said bouyant flotation member includes a foot cavity removably attached thereto whereby the foot cavity can be bailed by removing the foot cavity from the flotation member.

6. Water walking apparatus as defined in claim 1 further comprising means for controlling the spread and stride of said buoyant members with respect to one another, said means including a pair of flexible cables, each having its end attached to a respective inner side of one of said buoyant members and said cables being interlooped with one another.

7. Water walking apparatus as defined in claim 1 further comprising means for towing an additional flotation device, said means includes a ring attached to each buoyant member and said additional flotation device and a cable interconnecting said rings.

8. Water walking apparatus as defined in claim 1, further comprising means for clamping said buoyant members together so that they remain in a fixed relationship.

9. Apparatus for enabling an individual to walk on water including a pair of elongated buoyant water walker assemblies adapted for attachment to the feet of such individuals, each of said assemblies comprising:

a buoyant flotation member;

a runner member extending longitudinally along a substantial portion of the bottom of said buoyant member, said runner member having side walls forming a hollow section extending along its entire longitudinal length and being open at both longitudinal ends;

a cover member covering the bottom of said hollow section of said runner member;

control means arranged within said hollow section of said runner and being movable between a first position for allowing movement of said buoyant member in a forward direction and a second position for preventing slippage of said buoyant member in a rearward direction; and means for controlling the spread and stride of said buoyant members with respect to one another, said means including a pair of flexible cables, each having its ends attached to a respective inner side of one of said buoyant members and said cables being interlooped with one another.

* * * * *